US007934561B2

(12) United States Patent
Ormond

(10) Patent No.: US 7,934,561 B2
(45) Date of Patent: May 3, 2011

(54) DEPTH COMPENSATED SUBSEA PASSIVE HEAVE COMPENSATOR

(75) Inventor: Matthew Jake Ormond, Katy, TX (US)

(73) Assignee: InterMoor, Inc., Houston, TX (US)

( * ) Notice: Subject to any disclaimer, the term of this patent is extended or adjusted under 35 U.S.C. 154(b) by 442 days.

(21) Appl. No.: 12/099,593

(22) Filed: Apr. 8, 2008

(65) Prior Publication Data

US 2008/0251980 A1 Oct. 16, 2008

Related U.S. Application Data

(60) Provisional application No. 60/910,842, filed on Apr. 10, 2007.

(51) Int. Cl.
*E21B 29/12* (2006.01)
*B66D 1/26* (2006.01)
*B63B 3/00* (2006.01)

(52) U.S. Cl. ..... 166/355; 166/351; 254/277; 267/125; 60/413; 175/5; 114/264

(58) Field of Classification Search ..... 166/350–355; 405/195.1; 175/5; 60/413, 393; 114/264, 114/230.1; 254/277
See application file for complete search history.

(56) References Cited

U.S. PATENT DOCUMENTS 3,236,512 A * 2/1966 Stanojevic et al. ..... 267/126
3,793,835 A * 2/1974 Larralde ..... 60/413
3,824,896 A * 7/1974 Tull ..... 91/404
RE28,218 E * 10/1974 Hanes et al. ..... 175/5
3,839,976 A * 10/1974 Swenson et al. ..... 114/268
3,949,496 A 4/1976 de Konig et al.
4,098,082 A * 7/1978 Packer ..... 60/413
4,098,491 A * 7/1978 Larralde ..... 60/393
4,121,806 A * 10/1978 Iato et al. ..... 166/355
4,351,261 A * 9/1982 Shanks ..... 114/264
4,362,438 A * 12/1982 Spink ..... 405/195.1
4,501,219 A * 2/1985 Bates, Jr. ..... 114/264
4,759,256 A * 7/1988 Kovit et al. ..... 91/29
5,050,380 A * 9/1991 Jonsson ..... 60/413
5,209,302 A 5/1993 Robichaux et al.
5,846,028 A * 12/1998 Thory ..... 405/195.1
7,112,011 B2 * 9/2006 McCarty et al. ..... 405/224.4
7,231,981 B2 6/2007 Moe et al.
2004/0146363 A1 7/2004 Gjedebo

OTHER PUBLICATIONS

PCT International Search Report dated Jul. 15, 2009 for PCT/US09/39908 filed Apr. 8, 2009 (2 pgs.).
PCT Written Opinion of the International Searching Authority dated Jul. 15, 2009 for PCT/US09/39908 filed Apr. 8, 2009 (3 pgs.).

* cited by examiner

*Primary Examiner* — Thomas A Beach
(74) *Attorney, Agent, or Firm* — Klemchuk Kabasta LLP

(57) ABSTRACT

A depth compensated passive eave compensator comprises a first cylinder connected at its upper end to a vessel. A piston rod extends from a piston located within the first cylinder through the lower end thereof and is connected to subsea equipment. A second cylinder contains a compressed gas which maintains pressure beneath the piston of the first cylinder. The upper end of the first cylinder is connected to the upper end of a third cylinder having a piston mounted therein. A piston rod extending from the piston of third cylinder extends through the lower end thereof thereby applying the pressure of the sea to the piston of the third cylinder.

1 Claim, 3 Drawing Sheets

DEPTH COMPENSATED SUBSEA PASSIVE HEAVE COMPENSATOR

CROSS-REFERENCE TO RELATED APPLICATION

Applicant claims priority based on provisional patent application Ser. No. 60/910,842 filed Apr. 10, 2007, the entire content of which is incorporated herein by reference.

BACKGROUND AND SUMMARY

The Subsea Passive Heave Compensator (SPHC) is an installation tool designed to compensate vertical heave during sensitive installation of subsea equipment in an offshore environment. The vertical heave source is typically generated by an installation vessel's motion and or crane tip motion. The SPHC is designed to operate in air or in water at depths up to 10,000 ft. The SPHC is an inline tool that uses the principles of spring isolation to generate a net heave compensation effect or spring isolation effect. The tool is a nitrogen over oil spring dampening device. For spring isolation to occur, the natural period of the spring/mass system must be increased to a ratio higher than the forcing/heave period. Spring isolation begins to occurs when the natural period of a system is 1.414 times greater than the forcing/heave period.

Prior art heave compensators use spring isolation theory and hydraulic spring dampers do exist. The difficulties with these types of compensators are the effect that hydrostatic pressure has on the units. Further, hydrostatic pressure limits the ability to soften the spring system to achieve greater spring isolation. The limits imposed by depth effect are primarily the sensitivity to external pressure. The flatter the spring curve, the more sensitive it is to external pressure and the greater chance that errors in mass calculations can render the heave compensator useless. The hydrostatic pressure has a net effect on the piston rod calculated by the hydrostatic pressure times the piston rod area. This net load compresses the rod as the compensator is lowered to depth.

The novel design of the SPHC is the use of pressure balancing to mitigate/eliminate the depth effect. A compensating cylinder is added to the tool to eliminate the depth effect. The compensating cylinder uses area ratio's to provide a precise amount of back pressure on the low pressure side of the hydraulic cylinder to offset the load from the high pressure cylinder rod caused by hydrostatic pressure. FIG. 3 shows one prior art solution to external pressure with the use of a tail rod. The tail rod exerts an equal force as the piston rod and for this reason eliminates the depth effect. However, the length of the unit is doubled. Length is considered a constraint for handling purposes and the tail rod method is not considered ideal. Using the compensator cylinder with the heave compensator allows for a depth compensation to occur without adding to the length of the unit. With depth compensation, the volume of nitrogen can be increased to lengthen the natural period greater than when using a system without compensation.

BRIEF DESCRIPTION OF THE DRAWINGS

Table 1 is a listing of the component parts shown and identified in FIG. 2.

Table 2 is a series of formulas which describe the operating principles of the embodiment of the invention shown in FIGS. 1 and 2.

DETAILED DESCRIPTION

Figure 1:
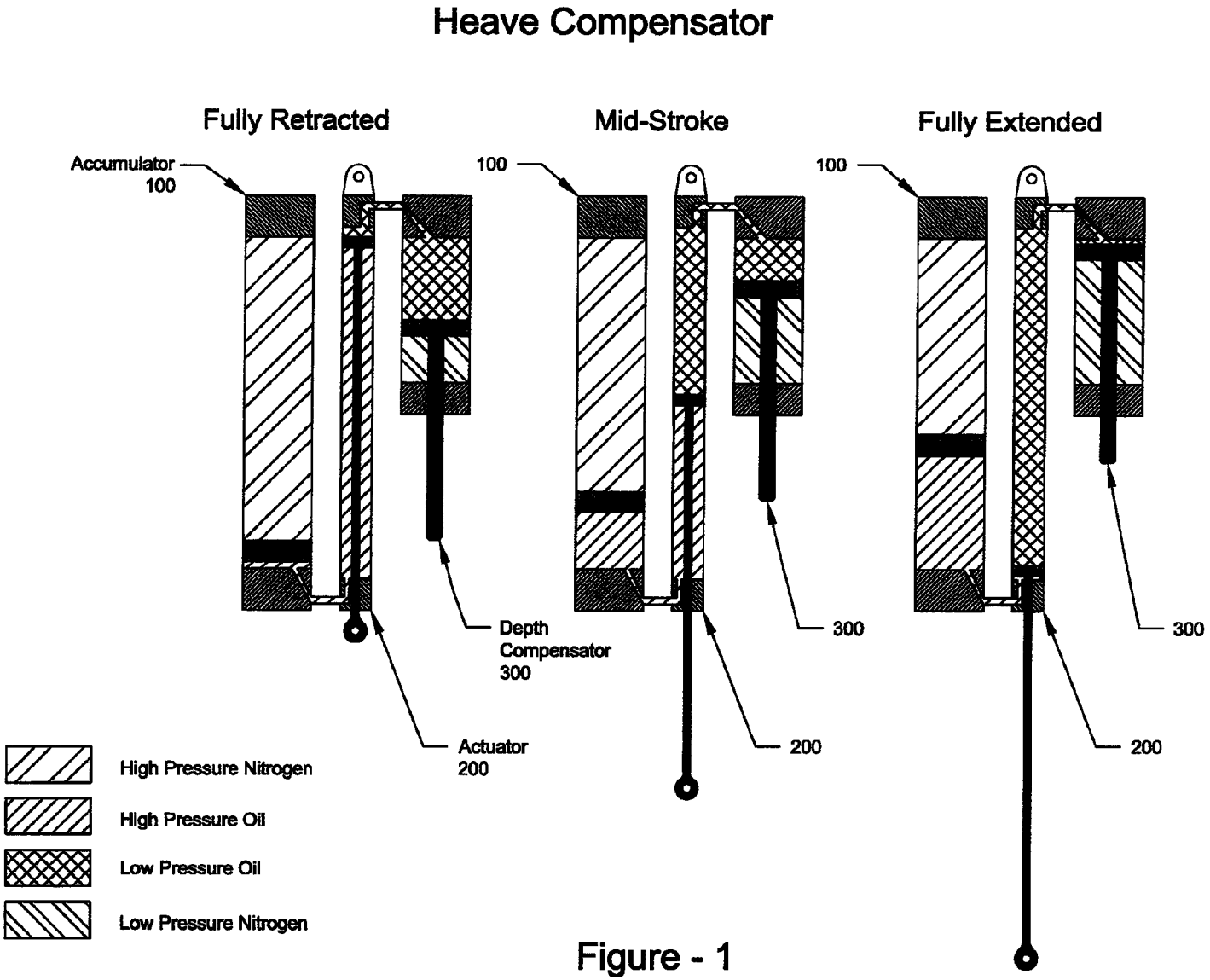
FIG. 1 is a schematic illustration of a Heave Compensator showing the device in various stages of its operation.

FIG. 1 is an illustration of the heave compensator with the piston rod in three different positions, retracted, mid-stroke and fully stroked. There are three major components to the heave compensator. To the left is the accumulator 100 the actuator 200 is in the middle and the depth compensator 300 is to the right.

Figure 2:
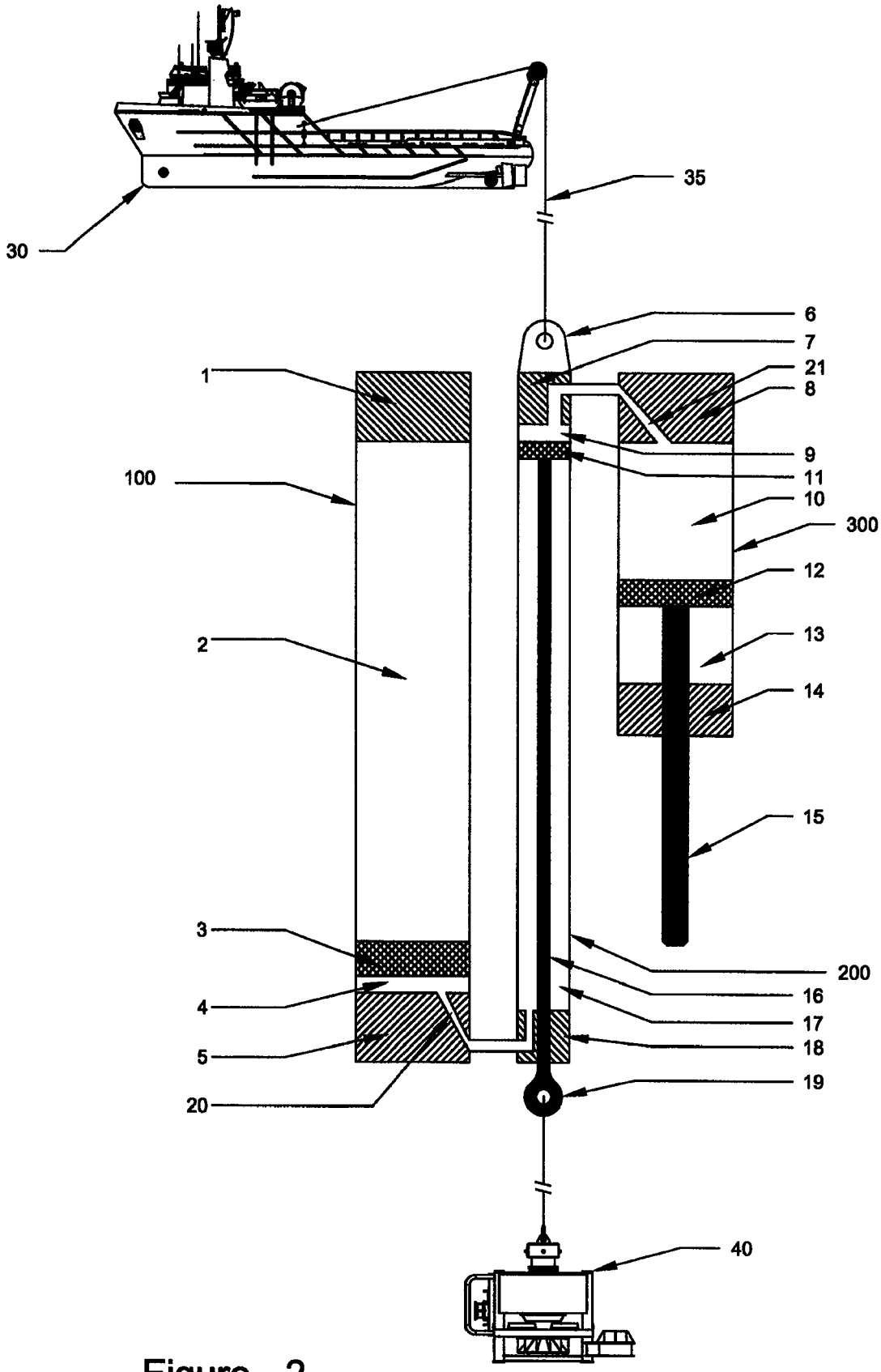
FIG. 2 is a view similar to FIG. 1 in which the major component parts of the Heave Compensator are specifically identified.
Figure 3:
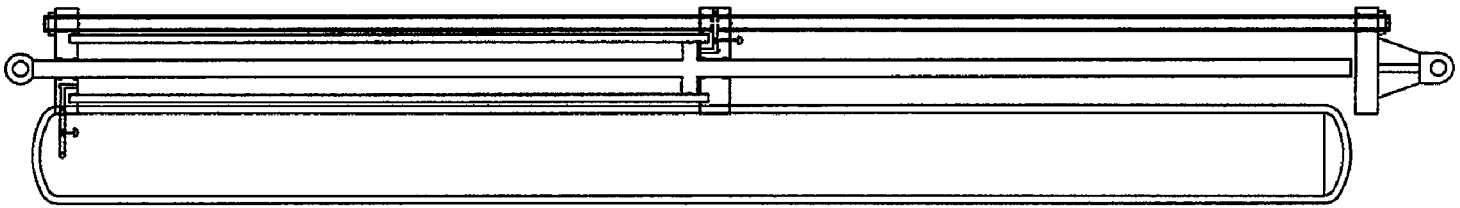
Figure - 3 PRIOR ART
FIG. 3 is an illustration of a prior art heave compensator.

FIG. 2 illustrates all of the major sub-components numbered 1 through 21. The component description and major-component group is identified in Table 1.

The Depth Compensated Subsea Passive Heave Compensator (SPHC) is rigged to the vessel 30 at the sea surface via work wire 35 at padeye 6 with 6 facing up and 19 facing down. The subsea equipment 40 is attached to the clevis 19. The accumulator chamber 2 is precharged such that the static position of the rod 16 is mid-stroke when the subsea equipment 40 is submerged. Pod 16 stokes up and down with vessel 30 motion to produce compensation for the subsea equipment 40.

On the high pressure side, when rod 16 strokes down, hydraulic fluid from chamber 17 is displaced through the ports 20 in end cap 5 and into the oil reservoir 4. As the hydraulic oil moves into chamber 4, piston 3 displaces upwards and compresses the nitrogen in chamber 2. The compression of nitrogen in chamber 2 creates an effective spring. The spring rate is a function of displaced oil from chamber 17 to the volume change of chamber 2.

On the low pressure side, when rod 16 strokes down, chamber 9 is filled with hydraulic oil from chamber 10 which passes through ports 21 in end cap 8. When the hydraulic fluid moves out of chamber 10, piston 12 and rod 15 move upward. The atmospheric chamber 13 expands and a vacuum is generated on chamber 13.

When the unit is submerged, the external water pressure produces a net hydrostatic pressure acting on the cross sectional area of rod 16 which generates a force on the rod. This force is counteracted by applying a pressure to the low pressure hydraulic fluid in chamber 9 and 10. The hydrostatic pressure on rod 15 is translated to a force on rod 15, which is translated to a pressure on fluid 10 and 9. That pressure translates to a force on piston 11, which counteracts the hydrostatic force generated on rod 16. The net effect of hydrostatic pressure on rod 16 and rod 15 is zero or a balanced force that has negated the depth effect. This allows the accumulator chamber 2 to be enlarged such that the stiffness of the system can be lowered.

The depth compensator 300 on the low pressure side is shortened such that it does not extend past the limits of the main high pressure cylinder. The diameter of the low pressure depth compensator chamber 10 is increased to provide appropriate volume of fluid to the displaced chamber 9 on the high pressure side. The ratio of piston rod area to piston area (15 to 12, and 16 to 11) is maintained the same for both the high pressure side actuator 200 and the low pressure depth compensator 300. The resulting effect generates a balanced system that is not affected by hydrostatic pressure due to varying depths. The equations producing the required ratios are shown in Table 2.

TABLE 1

| 901030-1018 | | |
|---|---|---|
| Sub-Component | Description | Major-Component Grouping |
| 1 | End Cap | Accumulator |
| 2 | High Pressure Nitrogen | Accumulator |
| 3 | Nitrogen/Oil Piston (floating) | Accumulator |
| 4 | High Pressure Oil Reservoir | Accumulator |
| 5 | End Cap w/ports | Accumulator |
| 6 | Top Padeye | Actuator |
| 7 | End Cap w/ports | Actuator |
| 8 | End Cap | Depth Compensator |
| 9 | Low Pressure Oil Chamber | Actuator |
| 10 | Low Pressure Oil Reservoir | Depth Compensator |
| 11 | High Pressure Piston | Actuator |
| 12 | Low Pressure Piston | Depth Compensator |
| 13 | Low Pressure Gas (~atmospheric) | Depth Compensator |
| 14 | End Cap w/Seals | Depth Compensator |
| 15 | Low Pressure Piston Rod | Depth Compensator |
| 16 | High Pressure Piston Rod | Actuator |
| 17 | High Pressure Oil Chamber | Actuator |
| 18 | End Cap/Rod Seals | Actuator |
| 19 | High Pressure Rod Clevis | Actuator |

a first piston rod connected to the first piston and extending downwardly therefrom through the lower end of the cylinder;

connector means for securing the first piston rod to subsea equipment located beneath the first cylinder;

a quantity of high pressure oil contained within the first cylinder between the first piston and the lower end of the first cylinder;

a second cylinder having an upper end and a lower end;

a second piston located within the second cylinder for reciprocation with respect thereto;

a quantity of high pressure gas located within the second cylinder between the upper end thereof and the second piston;

a quantity of high-pressure oil located in the second cylinder between the lower end thereof and the second piston;

conduit means operably connecting the lower end of the first cylinder to the lower end of the second cylinder;

a third cylinder having an upper end and a lower end;

a third piston mounted within the third cylinder for the reciprocation with respect thereto;

a quantity of low pressure oil contained with the third cylinder between the upper end thereof and the third piston;

conduit means operably connecting the upper end of the third piston and the upper end of the first piston;

TABLE 2

| 901030-1018<br>Depth Compensated Subsea Passive Heave Compensator | |
|---|---|
| $L_{High} = P_{hydrostatic} \times A_{rod_high}$ | Load on high pressure piston rod due to hydrostatic pressure |
| $\Delta P_{required_low} = \frac{L_{high}}{A_{piston_high}} = \frac{P_{hydrostatic} \times A_{rod_high}}{A_{piston_high}}$ | Increase in low pressure side required to offset load from high pressure piston rod |
| $L_{low} = P_{hydrostatic} \times A_{rod_low}$ | Load on low pressure piston rod due to hydrostatic pressure |
| $\Delta P_{comp_low} = \frac{L_{Low}}{A_{piston_low}} = \frac{P_{hydrostatic} \times A_{rod_low}}{A_{piston_low}}$ | Increase in low pressure side produced by low pressure rod (depth compensator) |
| $\Delta P_{required_low} = \Delta P_{comp_low}$ | Equate the required pressure differential with the pressure differential generated by depth compensator |
| $\therefore \frac{P_{hydrostatic} \times A_{rod_high}}{A_{piston_high}} = \frac{P_{hydrostatic} \times A_{rod_low}}{A_{piston_low}}$ | |
| $\therefore \frac{A_{rod_high}}{A_{piston_high}} = \frac{A_{rod_low}}{A_{piston_low}}$ | The resulting equation shows that the ratio of rod area to piston area must remain the same to achieve depth compensation (i.e. no net effect with depth) |

The invention claimed is:

1. A depth compensated subsea passive heave compensator comprising:

a first cylinder having an upper end and a lower end;

connector means mounted at the upper end of the first cylinder for connecting the first cylinder to a vessel at the sea surface;

a first piston located within the first cylinder for reciprocation with respect thereto;

a quantity of low pressure gas contained within the third cylinder between the lower end thereof and the third piston; and a second piston rod connected to the third piston and extending downwardly therefrom through the lower end thereof for applying the pressure of the sea to the third piston.

* * * * *

UNITED STATES PATENT AND TRADEMARK OFFICE

CERTIFICATE OF CORRECTION

PATENT NO. : 7,934,561 B2
APPLICATION NO. : 12/099593
DATED : May 3, 2011
INVENTOR(S) : Ormond It is certified that error appears in the above-identified patent and that said Letters Patent is hereby corrected as shown below:

In the Claims:

In claim 1, column 4, line 22, delete "with," and insert --within--.

Signed and Sealed this
Thirtieth Day of April, 2013

Teresa Stanek Rea
*Acting Director of the United States Patent and Trademark Office*